US005078300A

United States Patent [19]

Heu

[11] Patent Number: 5,078,300

[45] Date of Patent: Jan. 7, 1992

[54] STATIONERY CASE WITH MAGNETIC WHEEL DISPENSER

[76] Inventor: Nick Heu, 293 Pei Tun Road, Taichung, Taiwan

[21] Appl. No.: 491,955

[22] Filed: Mar. 12, 1990

[51] Int. Cl.[5] ..... B65H 3/16

[52] U.S. Cl. ..... 221/212

[58] Field of Search ..... 221/212, 217, 191, 192, 221/199, 255, 277, 286, 282; 206/350, 818, 340, 341, 337, 336

[56] References Cited

U.S. PATENT DOCUMENTS 4,986,417 1/1991 Hsu ..... 221/212

FOREIGN PATENT DOCUMENTS 1409537 10/1975 United Kingdom ..... 206/350

*Primary Examiner*—David H. Bollinger

*Attorney, Agent, or Firm*—Fleit, Jacobson, Cohn, Price, Holman & Stern

[57] ABSTRACT

A stationery case with magnetic wheel dispenser, which includes a casing having mounted therein a rotary wheel which is controlled to rotate with fingers so as to take up paper clips or other small stationery materials from a tray inside the casing by means of the attraction of magnets which are mounted on the inner face of the rotary wheel. A recessed receiving portion is made on the top cover of the case for receiving the materials which are carried out of the tray by the rotary wheel.

3 Claims, 3 Drawing Sheets

STATIONERY CASE WITH MAGNETIC WHEEL DISPENSER

BACKGROUND OF THE INVENTION

The present invention relates to a stationery case; more particularly, it relates to a stationery case with magnetic wheel dispenser. Following technology development, any products which are more practical and convenient in use would become more acceptable to consumers, and innovative design would be more attractive to induce people to buy. For example, for arrangement of stationery accessories, such as paper clips, thumb tacks, ... etc., consumers may require a device to contain such stationery accessories so that they can be conveniently picked up for use. For handling paper documents, various writing materials may be used to clip, clamp or bind up papers so as to keep them firmly in place. Regular stationery accessories are normally made of metal material. When a variety of stationery accessories are put together in a container, they may be disorderly disposed. Thus, one may take a lot of time to select a specific one from the disorderly disposed stationery accessories in such a container, and one may be easily pricked by the sharp-pointed ends of the stationery accessories therein during picking. There is a kind of magnetic attraction type stationery case for conveniently arranging paperclips, thumb pins and other stationery accessories, which includes a casing having a round hole on the top with a circular magnet internally provided around the round hole. When in use of such a magnetic attraction type stationery case, the top round hole of the stationery case must be blocked up with one hand and then turned upside-down permitting some pieces of stationery accessories attracted by the magnet for ready use. One disadvantage of this magnetic attraction type of stationery case is its inconvenience in operation. Another disadvantage of this magnetic attraction type stationery case is that stationery accessories may be disorderly attracted by the magnet that not easy to pick up one a time and may drop here and there from the stationery case when it is turned upside-down.

SUMMARY OF THE INVENTION

The main object of the present invention is to provide a stationery case with magnetic wheel dispenser which includes a rotary wheel projecting out of the case and having magnets thereon to efficiently carry stationer accessories out of the case for use by means of magnetic attraction.

A stationery case of the present invention includes a casing block which has therein a hollow space for holding a tray, which tray includes a concave bottom surface portion defining therewith a vertical inner wall portion at its lower region, which vertical inner wall portion has a semi-circular notch on its lowest end and an unitary projection extending upward from its top end, which projection has an axle hole in the center; a rotary wheel which has a pivot shaft revolvably fastened in the axle hole of the projection and a plurality of magnets equidistantly mounted on its inner face; and an upper cover which covers on the casing, having an elongated slot on the top, which elongated slot includes an expanded outlet hole on its rear end.

DETAILED DESCRIPTION OF THE PREFERRED EMBODIMENT

Figure 1:
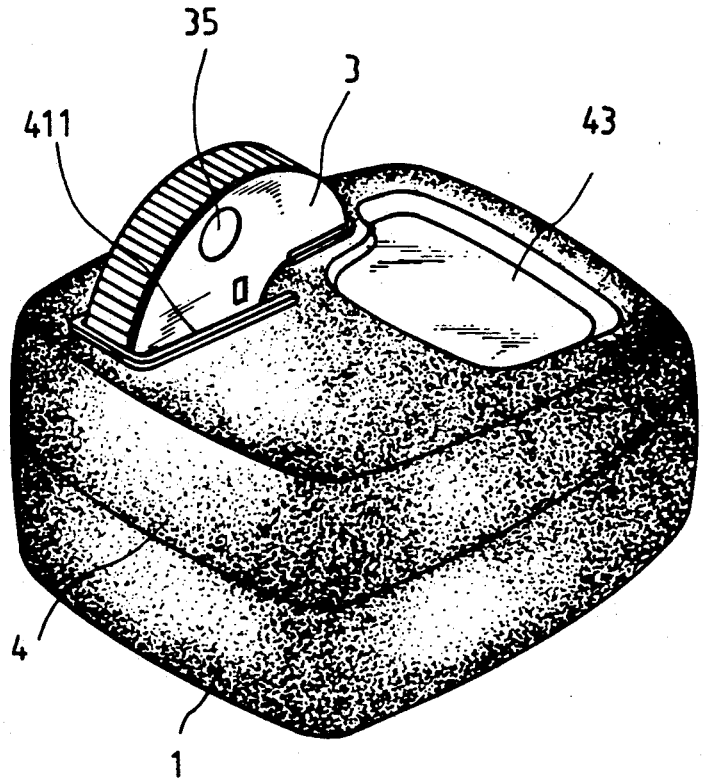
FIG. 1 is a perspective view of the preferred embodiment according to the present invention.
Figure 2:
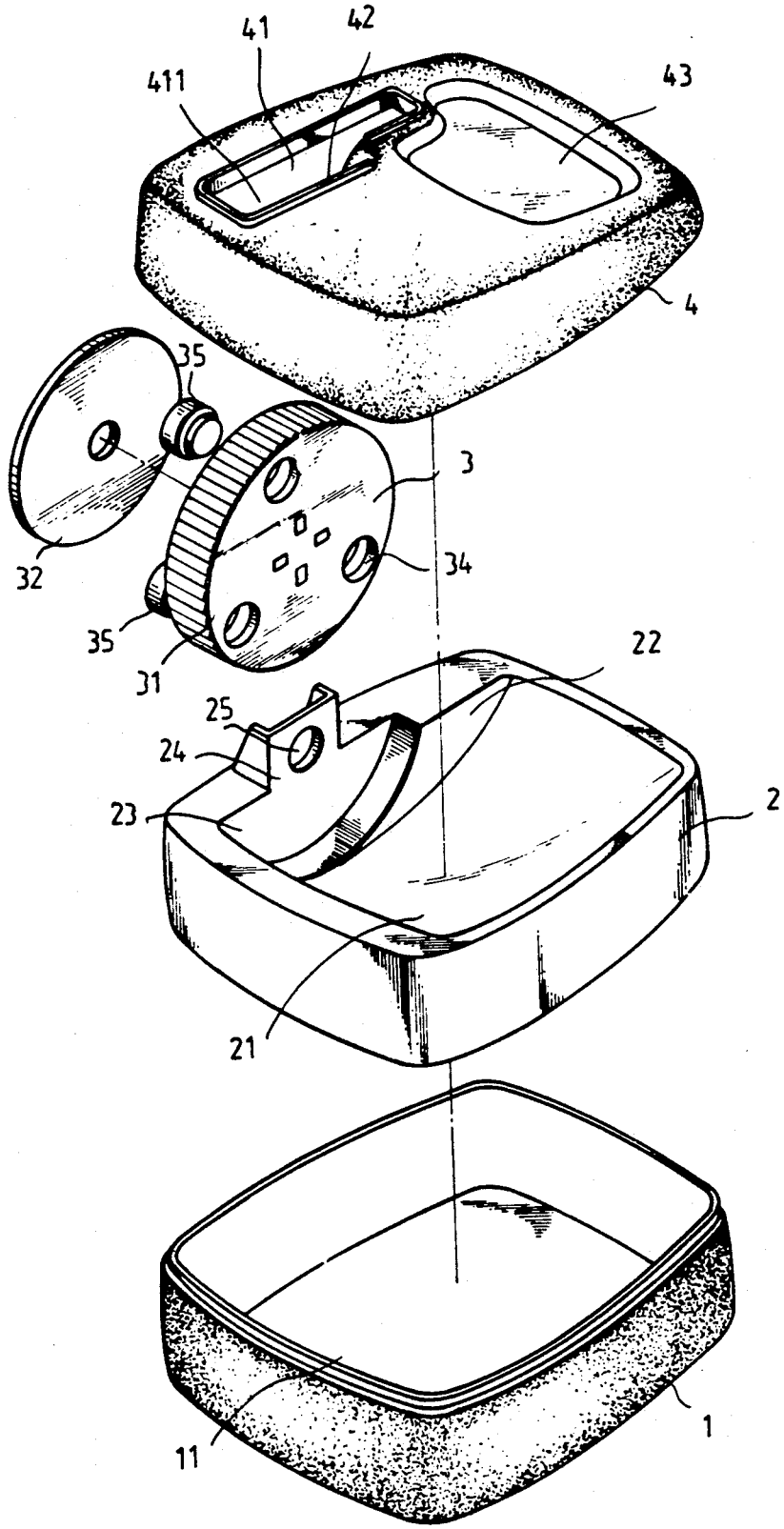
FIG. 2 is a perspective exploded view of FIG. 1.

Please refer to FIGS. 1 and 2, therein illustrated is a stationery case embodying the present invention and generally comprised of a casing 1, a tray 2, a rotary wheel 3 and an upper cover 4.

Figure 4:
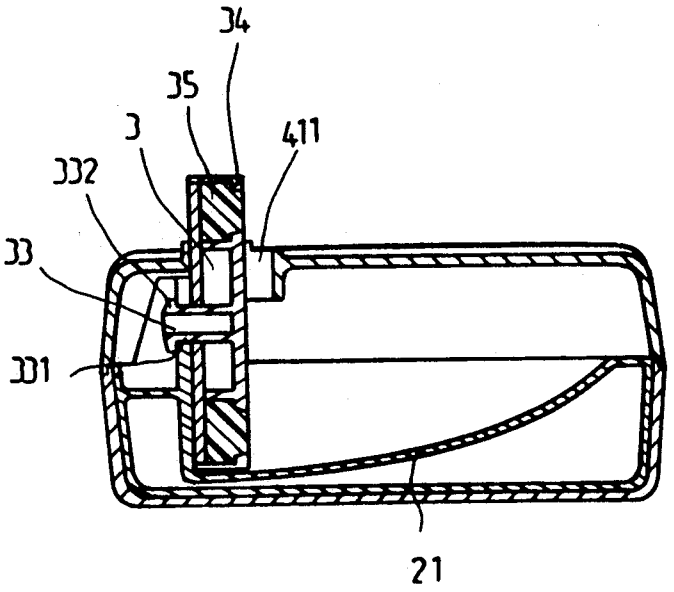
FIG. 4 is a side sectional view of FIG. 1.
Figure 3:
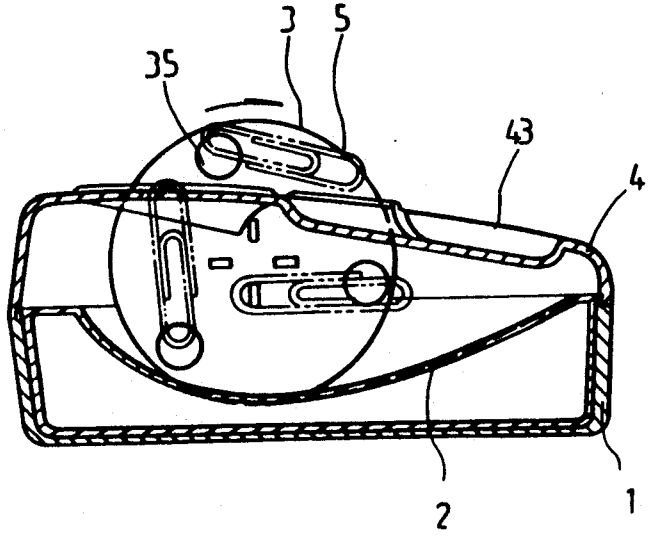
FIG. 3 is a front sectional view of FIG. 1.

The casing 1 is a rectangular base defining therein a hollow space 11 for receiving the tray 2. The tray 2 includes a concave bottom surface portion 21 extending downward from three of its four side wall portions toward the other side wall portion defining therewith a vertical inner wall portion 22 where is the lowest region of the concave bottom wall portion 21 for gathering paperclips or other writing materials which are placed in the tray 2. A semi-circular notch 23 is made on the vertical inner wall portion 22 at its lowest end. An unitary projection 24 extends upward from the side wall portion of the semi-circular notch 23. An axle hole 25 is made on the unitary projection 24 at the center of the circle which is defined by the semi-circular notch 23. The rotary wheel 3 includes a wheel body 31 attached with a cover 32 and arranged in size slightly smaller than the diameter of the semi-circular notch 23. The wheel body 31 has a central shaft 33 (as shown in FIG. 4) at one side for fastening in the axle hole 25 of the projection 24 so that the rotary wheel 3 can be rotated thereon. The central shaft 33 of the wheel body 31 is comprised of several resilient strips 331 equidistantly set to form a column-like structure. The resilient strips 331 comprise each a toothed portion 332 sloping inward on its outer side at its rear end. So that the central shaft 33 can be conveniently fastened in the axle hole 25 of the projection 24. A plurality of receiving holes 34 are made on the inner face of the wheel body 31 with each a magnet 35 fastened therein. It is most preferably that the range between magnets 35 is approximately equal to the length of paperclips 5. The upper cover 4 covers on the casing 1 through tongue-and-groove joint. An elongated slot 41 is made on the upper cover 4 in size and location corresponding to the length and width and the location of the rotary wheel 3. The elongated slot 41 includes an expanded outlet hole 411 on its rear end and in length equal to the radius of the rotary wheel 3 so that paperclips 5 can be taken out of the case one by one by means of the magnets 35 when the rotary wheel 3 is operated to rotate (as shown in FIG. 3). An unitary, raised strip portion 42 is made on the top of the upper cover 4 around the elongated slot 41 at which any paperclips carried out of the stationery case by the rotary wheel 3 will be separated from the rotary wheel 3. A recessed portion 43 is made on the top of the upper cover 4 for receiving the paperclips which are carried out of the stationery case by the rotary wheel 3 and separated therefrom by the raised strip portion 42.

The operation of the present invention is outlined herein after with reference to the drawings of FIGS. 3 and 4. The upper cover 4 is removed from the casing 1 and paperclips 5 are placed in the tray 2. After paperclips 5 are placed in the tray 2, the upper cover 4 is attached to the casing 1 to close up the tray 2. When to take up some paperclips 5 from the tray 2, the rotary wheel 3 is pushed to rotate toward the recessed portion 43. During the rotation of the rotary wheel 3, the magnets 35 rotate together with the rotary wheel. When a magnet 35 follow the rotary wheel to rotate to over the lowest region of the tray 2, small amount of paperclips 5 are simultaneously attracted to the rotary wheel 3 by the magnet 35 and carried out of the stationery case through the outlet hole 411 of the elongated slot 41 via the continuous rotation of the rotary wheel 3. As soon as paperclips 5 are carried out of the elongated slot 41, they can be picked up for use easily. The rotary wheel 3 can also continuously rotates until the paperclips 5 are carried out and stopped by the rised strip portion 42 to drop to the recessed portion 43. During the rotation of the rotary wheel 3, paperclips 5 may be disorderly carried by the rotary wheel 3 as shown in the drawing. The disorderly carried paperclips 5 will be automatically guided by the outlet hole 411 to the same direction for carrying out of the case.

I claim:

1. A stationery case with magnetic wheel dispenser, comprising:

a casing having therein a hollow space for receiving a tray, said tray including a concave bottom surface portion, a vertical inner wall portion intersecting said concave bottom surface at the lowest region of said concave bottom surface, said vertical inner wall portion having a semi-circular notch and an unitary projection extending upward from a top end, said projection having an axle hole in the center;

a rotary wheel having a pivot shaft revolvably fastened in said axle hole and a plurality of magnets equidistantly mounted on an inner surface of said rotary wheel; and an upper cover covering on said casing, having an elongated slot to receive said rotary wheel, said elongated slot including an expanded outlet hole at a rear end such that articles may be taken from the tray by the rotation of the rotary wheel.

2. A stationery case as claimed in claim 1, wherein an unitary, rised strip portion is made on the top of said upper cover around said elongated slot.

3. A stationery case as claimed in claim 2, wherein a recessed portion is made on the top surface of said upper cover in front of said elongated slot.

* * * * *